US006952640B2

(12) United States Patent
Bleile et al.

(10) Patent No.: US 6,952,640 B2
(45) Date of Patent: Oct. 4, 2005

(54) METHOD AND ARRANGEMENT FOR OPERATING AN INTERNAL COMBUSTION ENGINE

(75) Inventors: Thomas Bleile, Stuttgart (DE); Benedikt Kraus, Kornwestheim (DE); Dirk Foerstner, Stuttgart (DE); Ramon Wieland, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/805,195

(22) Filed: Mar. 22, 2004

(65) Prior Publication Data

US 2004/0186653 A1 Sep. 23, 2004

(30) Foreign Application Priority Data

Mar. 20, 2003 (DE) ..... 103 12 387

(51) Int. Cl.[7] ..... F02D 41/18; F02D 41/22; F02D 41/26

(52) U.S. Cl. ..... 701/108; 701/114

(58) Field of Search ..... 701/102, 103, 701/108, 114

(56) References Cited

U.S. PATENT DOCUMENTS 5,526,266 A * 6/1996 Rutan et al. ..... 701/114
6,688,166 B2 2/2004 Gerhard et al.
6,715,287 B1 4/2004 Engel et al.
2003/0029233 A1 * 2/2003 Ting et al. ..... 73/118.1

FOREIGN PATENT DOCUMENTS

| | | | |
|---|---|---|---|
| DE | 42 14 648 | 11/1993 | |
| DE | 199 63 358 | 7/2001 | |
| WO | WO 92/13184 A1 * | 8/1992 | ..... F02D/41/04 |

* cited by examiner

*Primary Examiner*—Andrew M. Dolinar
(74) *Attorney, Agent, or Firm*—Walter Ottesen

(57) ABSTRACT

The invention is directed to a method and an arrangement for operating an internal combustion engine assembly (1) which make possible a monitoring and, if required, correction of a quantity of an air system of the engine assembly (1). A physical quantity of the air system is computed from several input quantities with the aid of a physical model (5) of the air system of the internal combustion engine assembly (1). The at least one physical quantity is not an input quantity of the physical model (5). The at least one physical quantity, which is computed by means of the physical model (5), is compared to a measured value for the at least one physical quantity. One of the input quantities or a model internal quantity of the physical model (5) is monitored in dependence upon a deviation between the computed value and the measured value for the at least one physical quantity.

9 Claims, 3 Drawing Sheets

METHOD AND ARRANGEMENT FOR OPERATING AN INTERNAL COMBUSTION ENGINE

CROSS REFERENCE TO RELATED APPLICATION

This application claims priority of German patent application no. 103 12 387.3, filed Mar. 20, 2003, the entire content of which is incorporated herein by reference.

BACKGROUND OF THE INVENTION

U.S. Pat. No. 6,715,287 is incorporated herein by reference and discloses a method and an arrangement for controlling an internal combustion engine having an air system. Here, a physical quantity is determined by means of at least one physical model. This physical quantity characterizes the air system starting from at least one actuating variable and/or at least one measurement quantity which characterizes the state of the ambient air. The physical quantity is not an input quantity of the physical model.

SUMMARY OF THE INVENTION

The method of the invention and the arrangement of the invention for operating an internal combustion engine afford the advantage compared to the above that the at least one physical quantity, which is computed by means of the physical model, is compared to a measured value for the at least one physical quantity and that, in dependence upon a deviation between the computed value and the measured value for the at least one physical quantity, one of the input quantities or a model internal quantity of the physical model is monitored. In this way, the monitoring of the input quantity or of the model internal quantity can be realized independently of the actuator positions and can be realized for steady-state as well as for dynamic operating states of the internal combustion engine. Furthermore, no lambda sensor is necessary for the monitoring.

It is especially advantageous when the monitoring takes place in that the monitored input quantity or the model internal quantity of the physical model is corrected in dependence upon the deviation between the computed value and the measured value for the at least one physical quantity. In this way, a fault in the detection of the monitored input quantity or model internal quantity is compensated.

It is especially advantageous when the computed value and the measured value for the at least one physical quantity are supplied as input quantities to a control unit and that a corrective value is formed for the monitored input quantity or the model internal quantity of the physical model in dependence upon the deviation between the computed value and the measured value for the at least one physical quantity. In this way, the correction of the monitored input quantity or model internal quantity can be carried out especially easily and precisely.

It is also advantageous when several corrective values for different operating conditions of the internal combustion engine are stored in a characteristic field and when a corrective value is determined from the characteristic field in dependence upon the instantaneous operating point of the engine and when the monitored input quantity or model internal quantity of the physical model is corrected with the corrective value. In this way, a drag error of the controller can be reduced with the correction of the monitored input quantity or model internal quantity.

It is especially advantageous when the monitoring takes place in such a manner that the corrective value is compared to a pregiven threshold value and that a fault is detected when the corrective value exceeds the pregiven threshold value in magnitude. In this way, and for a suitable selection of the pregiven threshold value, a fault of the sensor for the determination of the monitored input quantity or model internal quantity can be detected.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
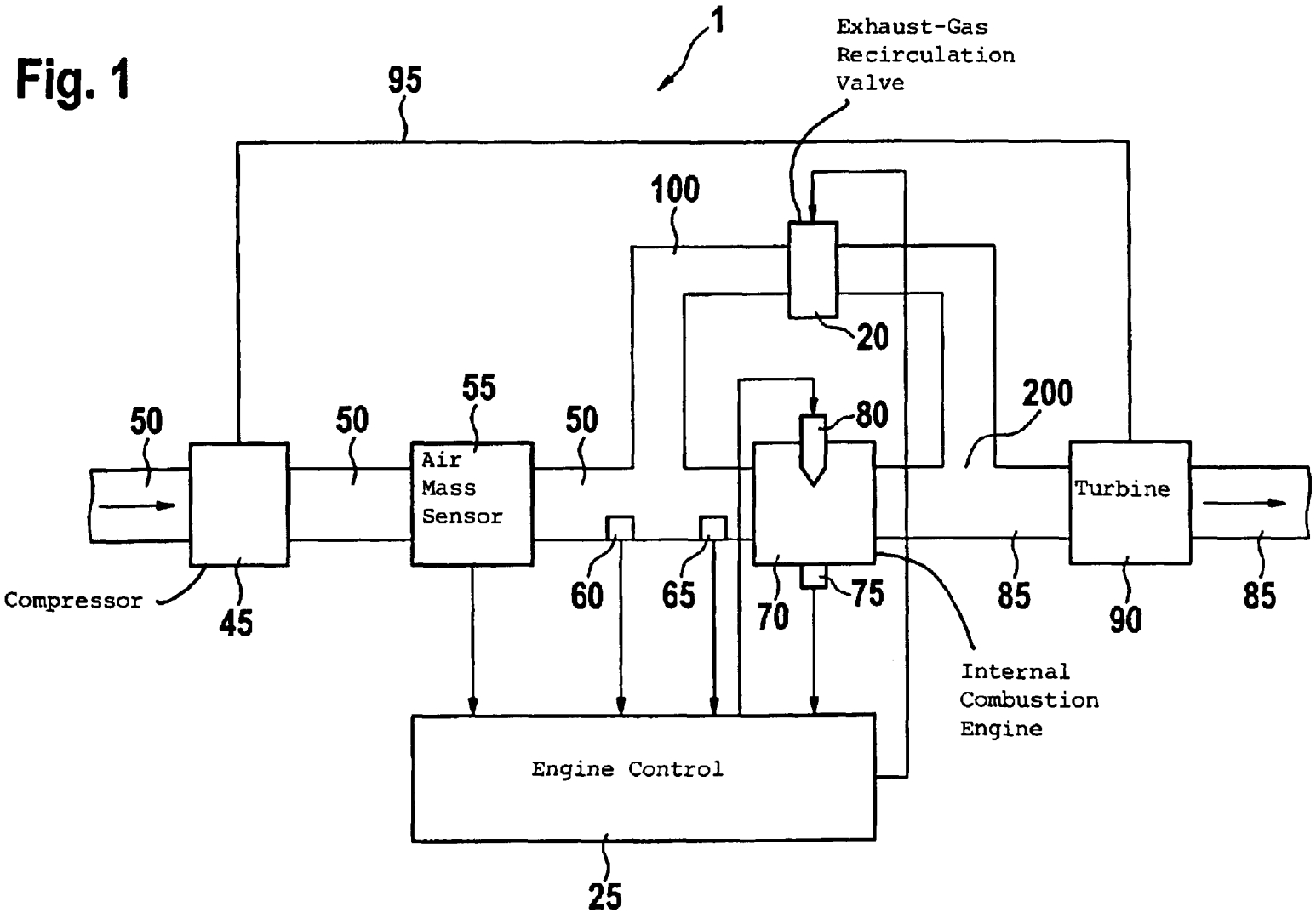
FIG. 1 shows a block circuit diagram of an internal combustion engine.

In FIG. 1, an internal combustion engine assembly is identified by reference numeral 1 and can be, for example, the engine assembly of a motor vehicle. The internal combustion engine assembly 1 includes an internal combustion engine 70 which, in the following, will be configured as a diesel engine by way of example. Fresh air is supplied via an air supply 50 to the diesel engine 70. The air supply 50 includes a compressor 45 which, in this example, is driven by a turbine 90 of an exhaust-gas turbocharger via a shaft 95. The flow direction of the fresh air into the air supply 50 is indicated by an arrow. An air mass sensor 55 is mounted in the air supply 50 downstream of the compressor 45. The air mass sensor 55 is, for example, a hot film air mass sensor. The air mass sensor 55 measures the fresh air mass flow supplied to the diesel engine 70 and conducts the measurement result to an arrangement which, in this case, is an engine control 25. A charge pressure sensor 60 and a charge temperature sensor 65 are arranged downstream of the air mass sensor 55 in the air supply 50. The charge pressure sensor 60 measures the charge pressure in the air supply 50 in advance of entry into the diesel engine 70 and supplies the measurement value to the engine control 25. The charge temperature sensor 65 measures the temperature in the air supply 50 in advance of entry into the diesel engine 70 and conducts the measurement value to the engine control 25. An exhaust-gas recirculation channel 100 feeds into the air supply 50 between the air mass sensor 55 and the entry into the diesel engine 70. In this way, a mixture of compressed fresh air and exhaust gas is supplied via an inlet valve (not shown) to a combustion chamber (not shown in FIG. 1) of the diesel engine 70.

Fuel is supplied via injection valve 80 to the combustion chamber. The injection valve 80 is driven by the engine control 25 in such a manner that a pregiven fuel mass flow is realized. The fuel mass flow can be pregiven in such a manner that a pregiven air/fuel mixture ratio adjusts in the combustion chamber of the diesel engine 70. A self-ignition then results in the combustion chamber of the diesel engine 70 and the air/fuel mixture in the combustion chamber is combusted. In this way, a piston of a cylinder of the diesel engine 70 is driven. The movement of the piston is transmitted to a crankshaft (not shown in FIG. 1) in a manner known per se. The exhaust gas is formed with the combustion of the air/fuel mixture and is discharged via an outlet valve (not shown) of the diesel engine into an exhaust-gas system 85.

An rpm sensor 75 is mounted on the diesel engine 70 and measures the engine rpm based on the movement of the crankshaft and the measurement result is conducted to the engine control 25. A portion of the exhaust gas is supplied via an exhaust-gas recirculation channel 100 again to the air supply 50. An exhaust-gas recirculation valve 20 is mounted in the exhaust-gas recirculation channel 100. A pregiven exhaust-gas recirculation rate adjusts depending upon the degree of opening of the exhaust-gas recirculation valve 20. The exhaust-gas recirculation valve 20 is driven by the engine control 25 for adjusting the degree of opening required for the realization of the pregiven exhaust-gas recirculation rate. The flow direction of the exhaust gas is likewise indicated by an arrow in FIG. 1. The turbine 90 of the exhaust-gas turbocharger is mounted in flow direction of the exhaust gas downstream of the diesel engine 70 and the branch 200 of the exhaust-gas recirculation channel 100.

Figure 2:
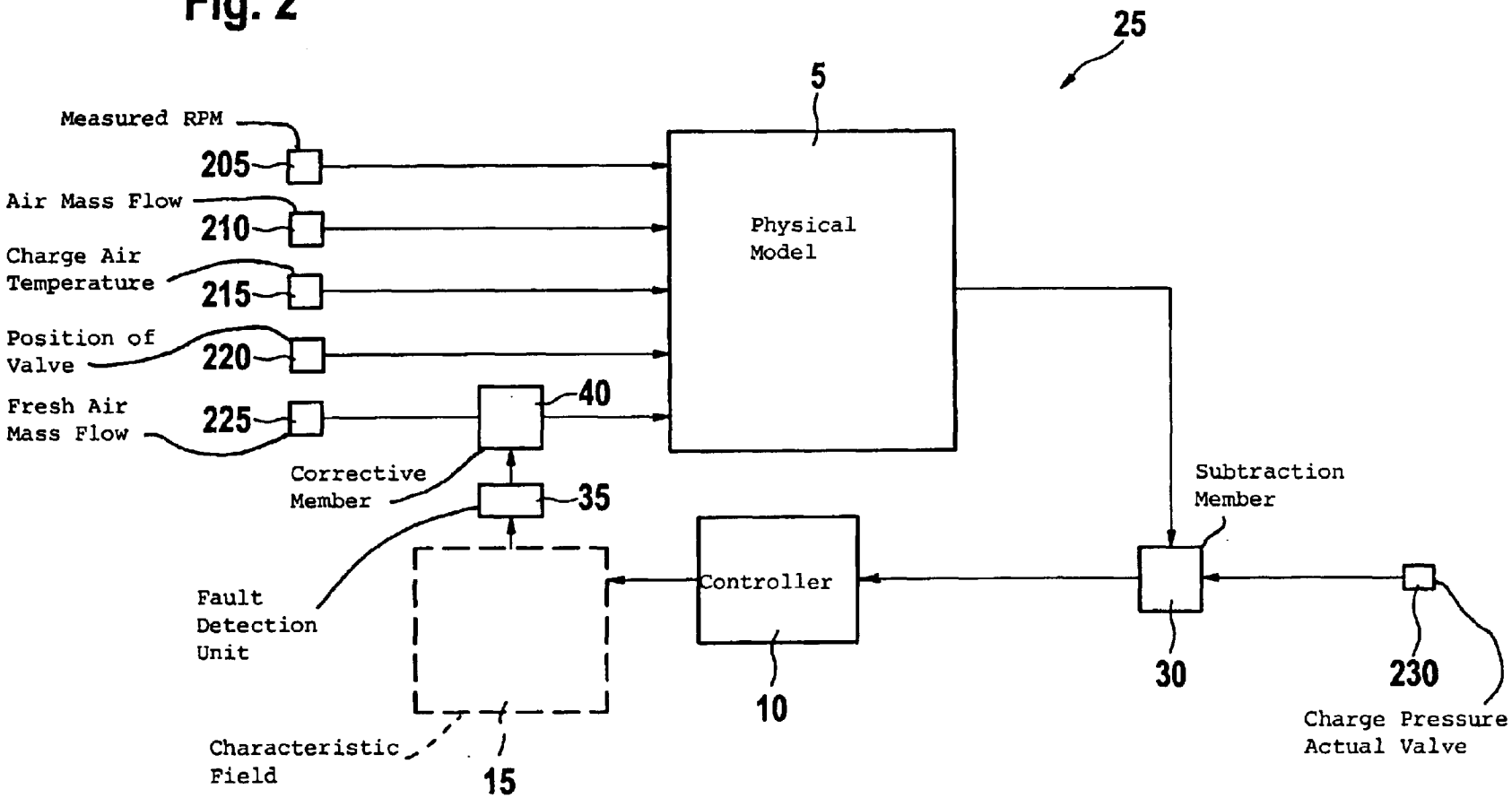
FIG. 2 shows a function diagram of an arrangement according to the invention; and, FIG. 3 is a flowchart for showing an exemplary sequence of the method of the invention.

A physical model 5 of the air system of the engine 1 is implemented in the engine control 25 in accordance with FIG. 2. With the aid of the physical model 5, at least one physical quantity of the air system is computed from several input quantities. The at least one physical quantity is not an input quantity of the physical model 5. The air system of the engine 1 is determined by the conditions in the following: the air supply 50, the exhaust-gas recirculation channel 100 and the exhaust-gas system 85 as well as the combustion chamber of the diesel engine 70.

According to the invention, the at least one physical quantity, which is computed by means of the physical model 5, is compared to a measured value for the at least one physical quantity and an input quantity or a model internal quantity of the physical model 5 is monitored in dependence upon a deviation between the computed value and the measured value for the at least one physical quantity.

In the following, and by way of example, the charge pressure is selected as the at least one physical quantity. In this example, the following are selected as input quantities of the physical model 5: the fresh air mass flow; the engine rpm; the injected fuel mass flow; the charge air temperature; and, the position or degree of opening of the exhaust-gas recirculation valve 20. Furthermore, in this example, the fresh air mass flow, which is supplied to the engine 1 or the diesel engine 70, is selected as the input quantity of the physical model 5 which is to be monitored.

According to FIG. 2, the measured rpm 205 is supplied to the physical model as the first input quantity. As the second input quantity, the air mass flow 210 is supplied by the engine control 25 with this air mass flow 210 being required for the adjustment of the pregiven air/fuel mixture ratio. The measured charge air temperature 215 is supplied from the charge air temperature sensor 65 to the physical model 5 as the third input quantity. The position 220, that is, the required degree of opening of the exhaust-gas recirculation valve 20, which is required for the adjustment of the pregiven exhaust-gas recirculation rate, is supplied by the engine control 25 as the fourth input quantity to the physical model 5. The measured fresh air mass flow 225, which is measured by the air mass sensor 55, is supplied via a corrective member 40 as a fifth input quantity to the physical model 5. The physical model 5 computes the charge pressure in the air supply 50 between the air mass sensor 55 and the diesel engine 70 in the manner disclosed in U.S. Pat. No. 6,715,287 incorporated herein by reference. The charge pressure is supplied to a subtraction member 30 and is there subtracted from the charge pressure actual value 230, which is measured by the charge pressure sensor 60. The difference which forms at the output of the subtraction member 30 is supplied to a controller 10. The controller 10 forms a corrective value for correcting the fresh air mass flow in dependence upon the supplied difference. According to a first embodiment, this corrective value is supplied directly to the corrective member 40 (not shown). The corrective member 40 can, for example, be an addition member wherein the fresh air mass flow, which is measured by the air mass sensor 55, is added to the corrective value and the sum is supplied to the physical model 5. In this way, the measurement signal of the air mass sensor 55 can be monitored. With the correction of the measurement signal of the air mass sensor 55 (that is, of the measured value for the fresh air mass flow), effects of the air mass signal error on the emission of toxic substances can be prevented. The controller 10 and the subtraction member 30 conjointly define a control unit.

In an alternate second embodiment, it can be provided that the corrective value, which is formed by the controller 10, is supplied to the corrective member 40 not directly, but rather, via a characteristic field 15 as shown. The characteristic field 15 is shown in phantom outline in FIG. 2. In each case, a corrective value can be supplied to the characteristic field 15 by the controller 10 for different operating conditions of the internal combustion engine assembly 1 and can be stored in the characteristic field 15 allocated to the corresponding operating point of the internal combustion engine assembly 1. The characteristic field 15 can supply the allocated corrective value directly to the corrective member 40 in dependence upon the instantaneous operating point of the engine assembly 1 which is imparted to the characteristic field 15 by the engine control 25. In this way, the fresh air mass flow 225 can be corrected in the corrective member 40 with the allocated corrective value in dependence upon the instantaneous operating point of the engine assembly 1. This affords the advantage that a drag error of the controller 10 can be reduced.

In a third embodiment, which supplements the first embodiment or the second embodiment, the corrective value is supplied from the controller 10 or characteristic field 15 via a fault detection unit 35 to the corrective member 40. The fault detection unit 35 conducts a monitoring in such a manner that the corrective value is compared to a pregiven threshold value and that a fault is detected when the corrective value exceeds, in magnitude, the pregiven threshold value.

In FIG. 2, the arrangement of the invention is shown in accordance with a third embodiment and is formed in this example by the engine control 25. The pregiven threshold value is so selected that it lies, in magnitude, above possible tolerances of the measurement signal of the air mass sensor 55, that is, of the measured fresh air mass flow. In this way, such tolerances of the measurement signal do not lead to a fault detection. The pregiven threshold value should be, in magnitude, as close as possible above the maximum permissible measurement tolerance in order to reliably detect as a fault a measurement deviation which is no longer tolerable. The detected fault is a fault of the air mass sensor 55 or its measurement signal, that is, of the measured fresh air mass flow. In the case of a detected fault, the fault detection unit 35 can cause the engine control 25 to initiate a fault reaction, which can, for example, as a final consequence, be the shutoff of the internal combustion engine assembly 1.

Alternatively, or in addition to the described monitored input quantity (in this example, the fresh air mass flow 225), also another input quantity can be monitored in the manner described. One such other input quantity of the physical model 5 can, for example, be an effective cross section which is cleared by an actuator, preferably the exhaust-gas recirculation valve 20 of a variable turbine geometry of the exhaust-gas turbocharger or a throttle flap (if present). Stated otherwise, the input quantity can be the effective cross section and therefore the degree of opening or the position 220 of the exhaust-gas recirculation valve 20, the variable turbine geometry or the throttle flap. These can be monitored in a corresponding manner and can be corrected.

Alternatively, or in addition to the described monitored input quantities, a quantity can also be monitored which is determined within the physical model 5 and defines a model internal quantity. This can, for example, be the exhaust-gas temperature in the exhaust-gas system 85. Additionally, this quantity can be determined by means of a temperature sensor. The model internal quantity can, for example, also be the exhaust-gas pressure in the exhaust-gas system 85 or it can otherwise be a model internal quantity known from U.S. Pat. No. 6,715,287, incorporated herein by reference. This model internal quantity can be monitored and also corrected by means of the apparatus 25 or the method of the invention in the manner described in the same way as described for the monitored input quantity. In this case, it is not an input quantity of the physical model 5 which is corrected by the corrective member 40, rather, the corresponding model internal quantity is corrected.

Figure 3:
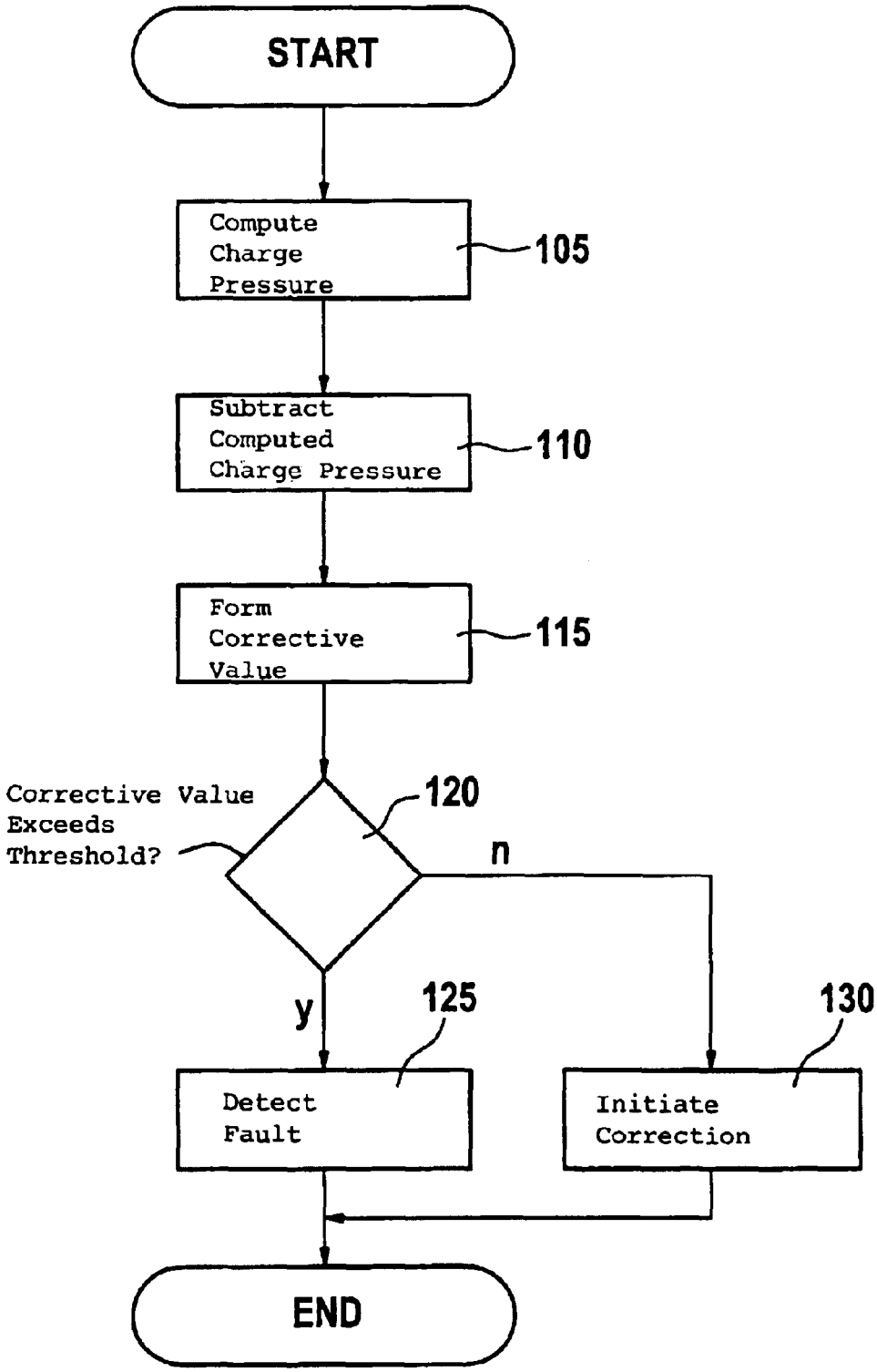

In FIG. 3, a flowchart is shown for an exemplary sequence of the method of the invention. At the start of the program, the physical model 5 computes the charge pressure (Block 105) in the air supply 50 from the above-mentioned input quantities in accordance with the manner described in U.S. Pat. No. 6,715,287, incorporated herein by reference. Thereafter, the program branches to program point 110.

At program point 110, the computed charge pressure is subtracted from the measured charge pressure 230 in the subtraction member 30 and the difference is supplied to the controller 10. Thereafter, the program branches to program point 115.

At program point 115, the controller 10 forms the corrective value for the fresh air mass flow 225 in dependence upon the supplied difference between the computed charge pressure and the measured charge pressure. The corrective value is supplied either indirectly via the characteristic field 15 in accordance with the second embodiment or directly in accordance with the first embodiment to the fault detection unit 35 according to the supplemented third embodiment. Thereafter, the program branches to program point 120.

At program point 120, the fault detection unit 35 checks whether the determined corrective value exceeds the pregiven threshold value in magnitude. If this is the case, then the program branches to program point 125; otherwise, the program branches to program point 130.

At program point 125, the fault detection unit 35 detects a fault of the measurement signal of the air mass sensor 55 and initiates, if required, a fault reaction. Thereafter, there is a movement out of the program.

At program point 130, the fault detection unit 35 initiates the correction of the measured fresh air mass flow 225 in the corrective member 40 via an addition of the corrective value. Thereafter, there is a movement out of the program.

According to the method of the invention and the arrangement of the invention, each desired input quantity and each desired model internal quantity of the physical model 5 can be monitored in the manner described and can, if needed, be corrected.

In modern internal combustion engines, increasingly higher requirements are imposed on the exhaust-gas characteristic values and consumption values as well as on system monitoring. Series scattering in the signal of the air mass sensor 55 leads to increased emissions of the vehicle because the signals, which are available for the control (open loop and/or closed loop), are burdened with errors. A monitoring of the measurement signal of the air mass sensor 55 is therefore absolutely necessary with a view to an on-board diagnosis. The use of the physical model 5 of the air system of the internal combustion engine assembly 1 permits computation of one or several physical quantities of the air system (in this example, the charge pressure) utilizing the described input signals in the manner described. These physical quantities can then be used for monitoring, if needed, with a correction of one of the input quantities, for example, of the fresh air mass flow or the model internal quantities.

While using the described physical model 5, it is possible, as described, to compute the fault of the measurement signal of the air mass sensor 55 in the form of a corrective value and to therewith monitor the measurement signal for the fresh air mass flow supplied to the internal combustion engine assembly 1 and to correct the same as may be required. If the error of the measurement signal of the air mass sensor 55 is known in the form of the described corrective value, then, with suitable measures in the engine control 25, the effects of the fault of the measurement signal on the emissions of toxic substances can be reduced insofar as the fault of the measurement signal is a tolerance-caused fault. A defect of the air mass sensor 55 can be detected on board when the corrective value exceeds the pregiven threshold value.

With the physical model 5 of U.S. Pat. No. 6,715,287, incorporated herein by reference, time constants of the air system can be simulated. These time constants are, for example, caused by the movement of one or several actuators in the air system, for example, of the exhaust-gas recirculation valve 20. In this way, it is possible to determine the charge pressure in steady-state operating conditions as well as in dynamic operating conditions of the internal combustion assembly 1 for any desired position of the actuator. As an actuator, the exhaust-gas recirculation valve 20 is shown in FIG. 1 by way of example. In addition, or alternatively, a throttle flap or a swirl flap can be provided in the air supply 50 in flow direction in advance of the entry 200 of the exhaust-gas recirculation channel 100 into the air supply 50 in order to adjust the pregiven exhaust-gas recirculation rate. Additionally, or alternatively, an actuator for the exhaust-gas recirculation cooling bypass can also be provided. The throttle flap, the exhaust-gas recirculation valve or the exhaust-gas recirculation cooling bypass can be driven by the engine control 25 to adjust the pregiven exhaust-gas recirculation rate.

An exhaust-gas recirculation cooler, which cools the recirculated exhaust gas, is disposed, under some circumstances, in the exhaust-gas recirculation channel 100. It is necessary to switch off this cooling in specific operating states (for example, for a cold start). For this reason, there is a bypass around this exhaust-gas recirculation cooler, the so-called exhaust-gas recirculation cooler bypass.

The charge pressure is no input quantity of the physical model 5. For this reason, the analytic redundancy between the computed charge pressure and the measured charge pressure can be used in the manner described in order to monitor a model internal quantity and/or an input quantity of the physical model 5 in dependence upon the operating point and, if needed, to correct the same. The charge pressure computed by means of the physical model 5 is correct during steady-state as well as during dynamic operating conditions of the internal combustion engine assembly 1 because the physical model 5 considers the time constants of the air system as described. For this reason, the computation of the corrective value for the fresh air mass flow 225 is valid also during dynamic operations of the engine assembly 1.

The measurement signal of the fresh air mass flow 225 functions as an input quantity to the physical model 5 in accordance with the embodiment described here. The controller 10 changes this measurement signal until the deviation between the computed charge pressure and the measured charge pressure becomes zero. In this way, the corrective value at the output of the controller 10 is the sought-after estimated value for the tolerance-caused defect of the measurement signal of the air mass sensor 55.

It is understood that the foregoing description is that of the preferred embodiments of the invention and that various changes and modifications may be made thereto without departing from the spirit and scope of the invention as defined in the appended claims.

What is claimed is:

1. A method for operating an internal combustion engine having an air system, the method comprising the steps of:

computing at least one physical quantity of said air system from several input quantities with the aid of a physical model of said air system wherein said at least one physical quantity is not one of said input quantities;

comparing said at least one physical quantity to a measured value for said at least one physical quantity;

monitoring one of said input quantities or a model internal quantity of said physical model in dependence upon a deviation between the computed value and said measured value;

correcting the monitored input quantity or said monitored model internal quantity in dependence upon said deviation;

supplying said computed value and said measured value to a control unit as input quantities;

forming a corrective value in said control unit in dependence upon said deviation for the monitored input quantity or the monitored model internal quantity;

storing several corrective values in a characteristic field for different operating conditions of said engine;

determining a corrective value from said characteristic field in dependence upon the instantaneous operating point of said engine; and, correcting the monitored input quantity or the monitored model internal quantity with said corrective value.

2. The method of claim 1, wherein the monitoring is conducted with the following further steps:

comparing the corrective value to a pregiven threshold value; and, detecting a fault when said corrective value exceeds said pregiven threshold value in magnitude.

3. The method of claim 2, wherein a charge pressure of said engine is selected as said at least one physical quantity.

4. The method of claim 2, wherein a fresh air mass flow supplied to said engine is selected as a monitored input quantity.

5. The method of claim 2, wherein an effective cross section cleared by an actuator is selected as a monitored input quantity.

6. The method of claim 5, wherein said actuator is an exhaust-gas recirculation valve.

7. A method for operating an internal combustion engine having an air system, the method comprising the steps of:

computing at least one physical quantity of said air system from several input quantities with the aid of a physical model of said air system wherein said at least one physical quantity is not one of said input quantities;

comparing said at least one physical quantity to a measured value for said at least one physical quantity;

monitoring one of said input quantities or a model internal quantity of said physical model in dependence upon a deviation between the computed value and said measured value;

wherein the following are selected as input quantities of said physical model: a fresh air mass flow, an engine rpm, a fuel mass flow, a charge air temperature and at least a position of an actuating member of said engine; and, wherein said actuating member is an exhaust-gas recirculation valve.

8. The method of claim 1, wherein an exhaust-gas temperature is selected as a monitored model internal quantity.

9. An arrangement for operating an internal combustion engine having an air system, the arrangement comprising:

a physical model of said air system for computing at least one physical quantity of said air system from several input quantities wherein said at least one physical quantity is not one of said input quantities;

comparator means for comparing said at least one physical quantity to a measured value for said at least one physical quantity;

monitoring means for monitoring one of said input quantities or a model internal quantity of said physical model in dependence upon a deviation between the computed value and said measured value;

means for correcting the monitored input quantity or said monitored model internal quantity in dependence upon said deviation;

means for supplying said computed value and said measured value to a control unit as input quantities;

means for forming a corrective value in said control unit in dependence upon said deviation for the monitored input quantity or the monitored model internal quantity;

means for storing several corrective values in a characteristic field for different operating conditions of said engine;

means for determining a corrective value from said characteristic field in dependence upon the instantaneous operating point of said engine; and, means for correcting the monitored input quantity or the monitored model internal quantity with said corrective value.

* * * * *